US007607922B2

(12) United States Patent
Kerekes et al.

(10) Patent No.: US 7,607,922 B2
(45) Date of Patent: Oct. 27, 2009

(54) CARD EDGE COAXIAL CONNECTOR

(75) Inventors: James R. Kerekes, Waterville, MN (US); M'hamed Anis Khemakhem, Minnetonka, MN (US); Eric L. Lovaasen, Chaska, MN (US)

(73) Assignee: ADC Telecommunications, Inc., Eden Prairie, MN (US)

( * ) Notice: Subject to any disclaimer, the term of this patent is extended or adjusted under 35 U.S.C. 154(b) by 0 days.

(21) Appl. No.: 12/075,404

(22) Filed: Mar. 10, 2008

(65) Prior Publication Data

US 2008/0160793 A1 Jul. 3, 2008

Related U.S. Application Data

(63) Continuation of application No. 11/489,366, filed on Jul. 18, 2006, now Pat. No. 7,357,641, which is a continuation of application No. 11/138,093, filed on May 26, 2005, now Pat. No. 7,118,382, which is a continuation of application No. 10/114,897, filed on Apr. 2, 2002, now Pat. No. 6,935,866.

(51) Int. Cl.
*H01R 12/00* (2006.01)

(52) U.S. Cl. ..... 439/63; 439/549; 439/629

(58) Field of Classification Search ..... 439/63, 439/65, 374, 545, 547, 549, 629
See application file for complete search history.

(56) References Cited

U.S. PATENT DOCUMENTS

| | | | |
|---|---|---|---|
| 3,553,607 | A | 1/1971 | Lehrfeld |
| 3,594,708 | A | 7/1971 | Lalonde |
| 3,622,915 | A | 11/1971 | Davo |
| 3,662,318 | A | 5/1972 | Decuyper |
| 3,689,865 | A | 9/1972 | Pierini et al. |
| 3,697,926 | A | 10/1972 | Krafthefer |
| 4,087,151 | A | 5/1978 | Robert et al. |
| 4,125,308 | A | 11/1978 | Schilling |
| 4,280,112 | A | 7/1981 | Eisenhart |
| 4,346,355 | A | 8/1982 | Tsukii |
| 4,656,441 | A | 4/1987 | Takahashi et al. |
| 4,695,112 | A | 9/1987 | Maston et al. |
| 4,724,409 | A | 2/1988 | Lehman |
| 4,801,269 | A | 1/1989 | Howard et al. |
| 5,046,952 | A | 9/1991 | Cohen et al. |
| 5,049,093 | A | 9/1991 | Walter |
| 5,344,340 | A | 9/1994 | Bouleau |
| 5,404,117 | A | 4/1995 | Walz |
| 5,411,409 | A | 5/1995 | Gray et al. |
| 5,478,258 | A | 12/1995 | Wang |
| 5,657,385 | A | 8/1997 | Reichle |
| 5,759,069 | A | 6/1998 | Kitatani et al. |
| 5,879,177 | A | 3/1999 | Honma |
| 5,897,384 | A | 4/1999 | Hosler, Sr. |
| 6,007,347 | A | 12/1999 | Keldsen et al. |

(Continued)

*Primary Examiner*—James Harvey
(74) *Attorney, Agent, or Firm*—Merchant & Gould P.C.

(57) ABSTRACT

An adapter having a housing, a ground clip and an adapter subassembly all located in the housing. The adapter subassembly includes a proximal portion that can be coupled to a coaxial connector and a distal portion that can be coupled to a printed circuit board. A central conductor in the form of an elongated shaft that runs through the subassembly and has a ball contact end for contacting a conductor located on a printed circuit board and the elongated shaft is tapered in a region near the ball contact.

10 Claims, 7 Drawing Sheets

U.S. PATENT DOCUMENTS 6,030,231 A 2/2000 Sarkiniemi
6,045,402 A * 4/2000 Embo et al. ..... 439/579
6,065,976 A 5/2000 Wang
6,079,986 A 6/2000 Beshears
6,100,774 A 8/2000 Cox et al.
6,238,218 B1 5/2001 Baffert
6,468,089 B1 10/2002 Hubbard et al.
6,551,115 B1 4/2003 Li et al.
6,705,875 B2 3/2004 Berghorn et al.
6,776,656 B2 8/2004 Lehtonen et al.
6,935,866 B2 8/2005 Kerekes et al.
7,118,382 B2 10/2006 Kerekes et al.
7,357,641 B2 * 4/2008 Kerekes et al. ..... 439/63
2003/0186565 A1 10/2003 Kerekes et al.
2005/0215083 A1 9/2005 Kerekes et al.
2006/0258180 A1 11/2006 Kerekes et al.
2008/0160793 A1 * 7/2008 Kerekes et al. ..... 439/63

* cited by examiner

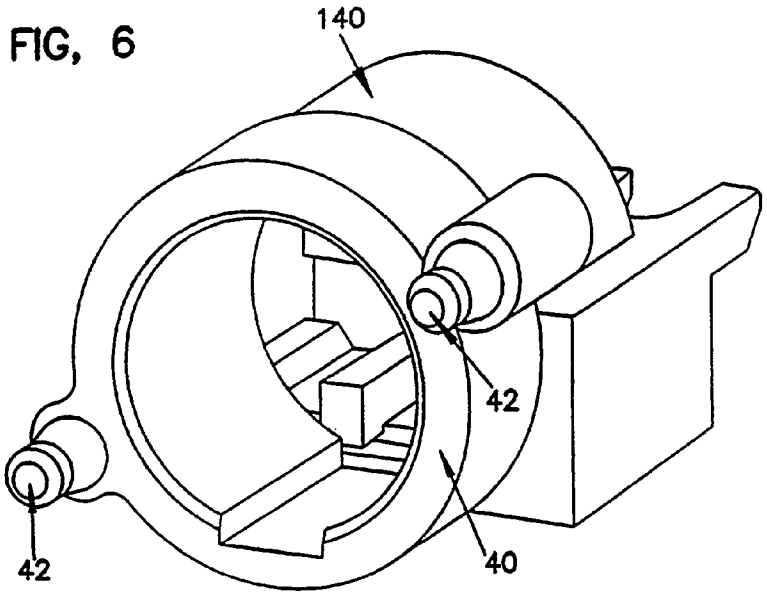
FIG, 6
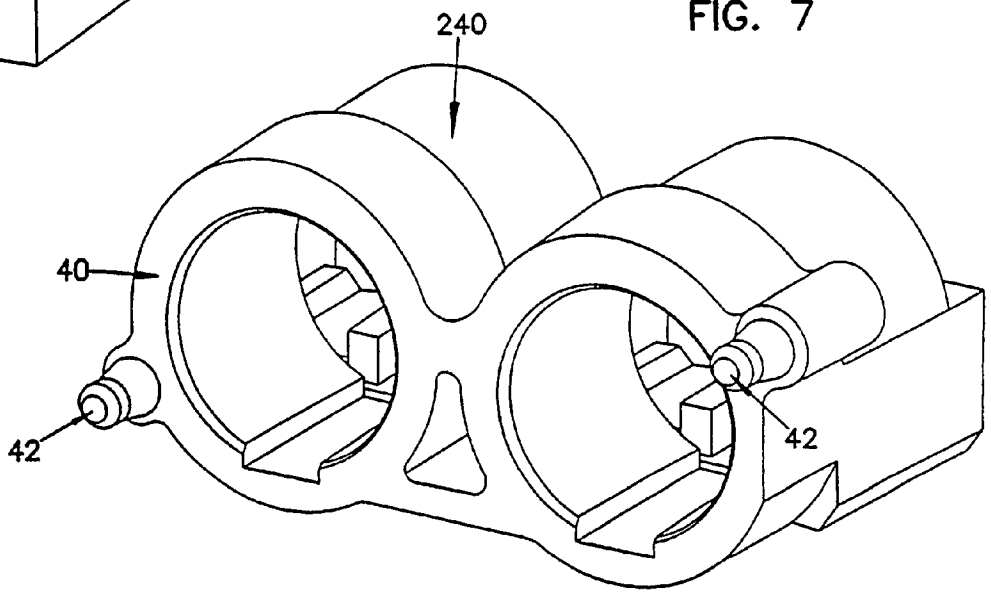
FIG. 7

CARD EDGE COAXIAL CONNECTOR

CROSS REFERENCE TO RELATED APPLICATIONS

This application is a continuation U.S. patent application Ser. No. 11/489,366, filed Jul. 18, 2006, now U.S. Pat. No. 7,357,641 which is a continuation of U.S. patent application Ser. No. 11/138,093, filed May 26, 2005, and issued as U.S. Pat. No. 7,118,382 on Oct. 10, 2006, which is a continuation of U.S. patent application Ser. No. 10/114,897, filed Apr. 2, 2002, and issued as U.S. Pat. No. 6,935,866 on Aug. 30, 2005, hereby incorporated by reference.

BACKGROUND OF THE INVENTION

Various types of electrical card edge connectors exist, however, very few are optimized for RF performance. Known RF card edge connectors require solder connections or complicated mechanical connections between a coaxial transmission line and a trace on a printed circuit board or complicated grounding techniques. These types of connectors make it difficult to replace the connectors quickly and easily. In addition, some connectors do not have a universal coaxial connection that allows the connector to be used with a variety of different types of coaxial connectors. Also, some of these known connectors are not modular so they do not easily lend themselves to being used in an array.

It is desirable to provide an adapter that does not require permanent couplings such as solder or tools to assemble the adapter to a printed circuit board so that the adapter can be easily and quickly replaced. In addition, it is desirable to provide an adapter that is modular so that it can be used singularly or in an array. Also, it is desirable to provide an adapter design that is independent of the coaxial connector interface so that various styles of coaxial connectors may be used with the adapter. In addition, it is desirable to provide an adapter that is simple to manufacture and inexpensive.

SUMMARY OF THE INVENTION

According to a first aspect of the invention, there is provided a high frequency adapter for coupling a printed circuit board having a signal trace and ground, to a coaxial connector. The adapter includes a housing, a ground clip and an adapter subassembly. The housing is designed to be removably coupled to the printed circuit board. The ground clip is located in a rear inner portion of the housing. The adapter subassembly includes a contact having a proximal portion and a distal portion and an elongated shaft coupling the proximal portion to the distal portion wherein the distal portion is configured to mate with the coaxial connector and the proximal portion is configured to mate with the printed circuit board. The elongated shaft is tapered in the proximal portion and the proximal portion terminates in a ball contact. The ball contact slides over the trace on the printed circuit board and electrically couples the trace on the printed circuit board to the contact. An insulator surrounds the contact and a conductive cylindrical connector surrounds the insulator so that the contact is concentrically positioned within the conductive cylindrical connector.

According to a second aspect of the invention, there is provided an adapter for coupling a printed circuit board to a coaxial connector. The adapter includes a housing and a center conductor. The housing has a first end and a second end, the first end of the housing is configured to be coupled to a standard coaxial connector, the second end of the housing has a printed circuit board receiving groove. The receiving groove is configured to slide over a portion of the printed circuit board. The center conductor is located within the housing and has a printed circuit board contacting end that slides over a conductive contact located on a first surface of the printed circuit board. The center conductor has a coaxial connector end opposite the printed circuit board contacting end and coupled thereto by an elongated shaft. The elongated shaft is tapered in a region remote from the coaxial connector and the coaxial contacting end is ball shaped.

BRIEF DESCRIPTION OF THE DRAWINGS

FIG. 6 is a perspective view of a single barrel housing according to a preferred embodiment of the present invention.

FIG. 7 is a perspective view of a double barrel housing according to a preferred embodiment of the present invention.

DETAILED DESCRIPTION OF THE PREFERRED EMBODIMENT

Figure 1:
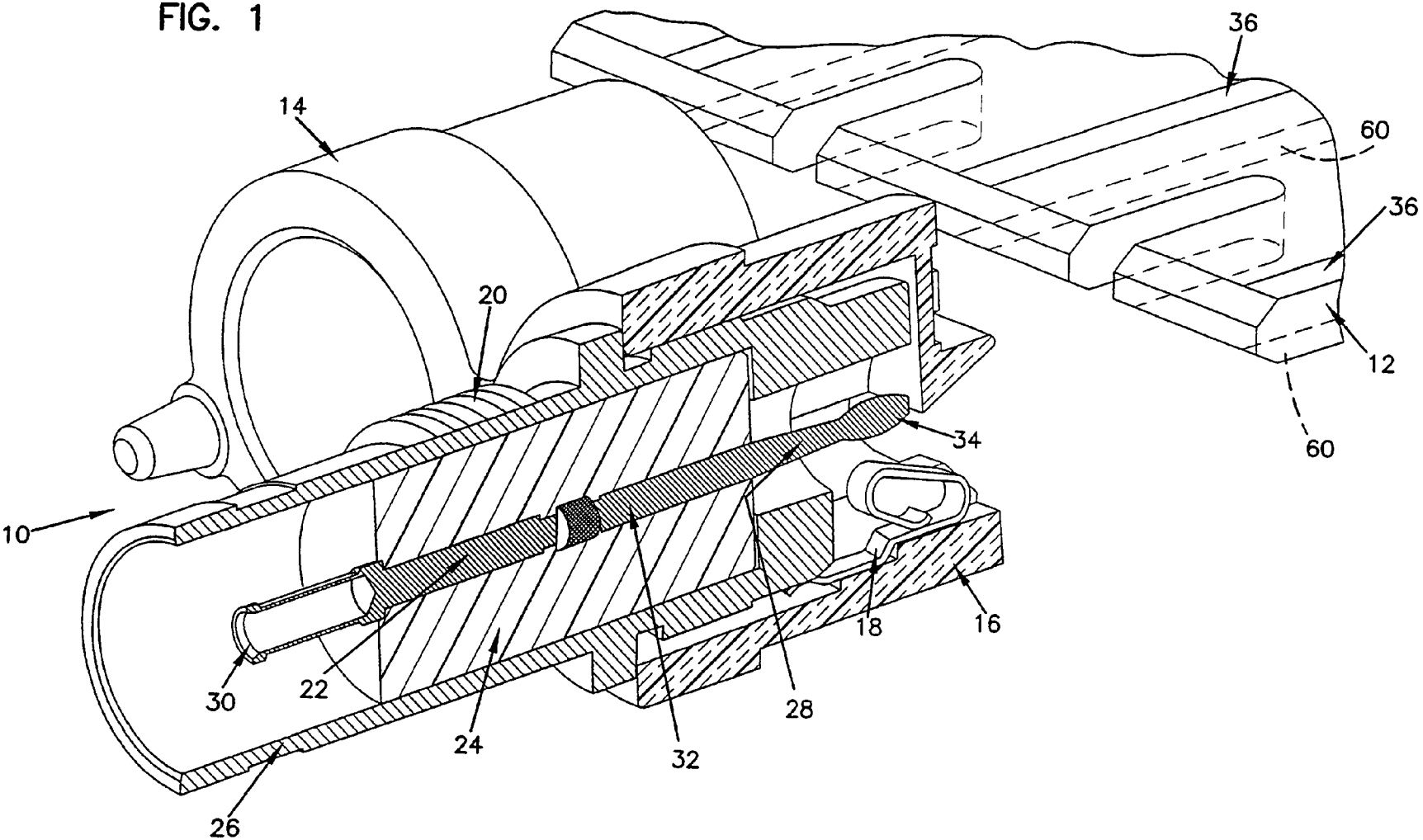
FIG. 1 is a cross-sectional perspective view of a high frequency adapter according to a preferred embodiment of the present invention.

FIG. 1 is a cross-sectional perspective view of a high frequency adapter 10 according to a preferred embodiment of the present invention. The adapter 10 is used to couple a printed circuit board 12 and a coaxial connector (not shown). The adapter 10 includes a housing 14 that is designed to be removably coupled to the printed circuit board 12. In addition, located in a rear inner portion 16 of the housing 14 is a ground clip 18. Also included in the housing 14 is an adapter subassembly 20 that includes a contact 22, an insulator 24 surrounding the contact 22 and a conductive cylindrical connector 26 surrounding the insulator 24. The contact 22 has a proximal portion 28 and a distal portion 30 and an elongated shaft 32 coupling the proximal portion 28 to the distal portion 30. The distal portion 30 of the contact 22 is designed to mate with a coaxial connector (not shown) and the proximal portion 28 of the contact 22 is designed to mate with the printed circuit board 12. The elongated shaft 32 is tapered in the proximal portion 28 and the proximal portion of the contact 22 terminates in a ball contact 34. When the adapter 10 is coupled to a printed circuit board 12, the ball contact 34 slides over a trace 36 located on the board 12 to electrically couple the trace 36 to the contact 22. The distal end 30 of the contact 22 can be electrically coupled to a coaxial connector (not shown). The adapter 10 thereby couples the printed circuit board 12 to a coaxial connector. The adapter 10 can be coupled to any type of coaxial connector such as a BNC connector or an F connector, for example.

The tapered shape of the contact 22 allows the adapter 10 to reduce the impact of vibrations on the electrical connection between the contact 22 and the printed circuit board 12. In addition, it is flexible while still maintaining an acceptable level of stability. The ball contact 34 provides tolerance flexibility that allows the adapter to be coupled to a printed circuit board 12 that is not completely parallel with the axis of the contact 22.

In a preferred embodiment, the housing 14 is made of plastic. The contact 22 is press-fitted into the insulator 24 and the insulator 24 is press-fitted in the outer cylindrical conductive connector 26. The ground clip 18 is also press-fitted into the inner rear portion 16 of the housing 14.

Figure 8:
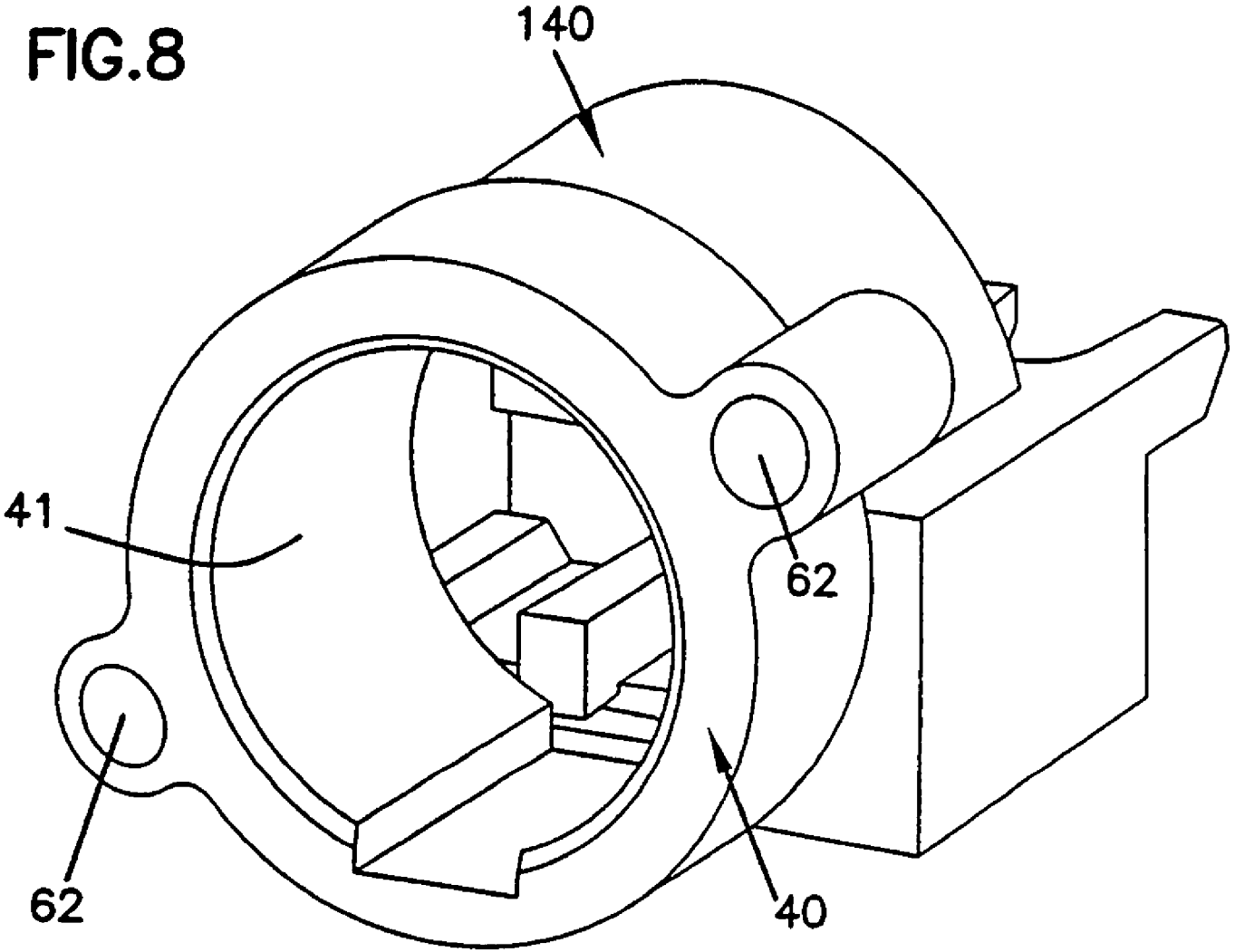
FIG. 8 is a perspective view of a single barrel housing according to an alternative embodiment of the present invention.

FIG. 6 is a perspective view of a single barrel housing 140 according to a preferred embodiment of the present invention which houses a single adapter subassembly 20. FIG. 7 is a perspective view of a double barrel housing 240 according to a preferred embodiment of the present invention which houses a pair of adapter subassemblies 20. Each housing 140, 240 has a front face 40 that has a pair of alignment pins 42 which fit into a panel (not shown) to properly align the housing 140, 240 with the panel. In the single barrel embodiment shown in FIG. 6, the pair of pins 42 are located on opposite sides of the barrel. In the double barrel embodiment shown in FIG. 7, one pin 42 is located on each barrel. Alternatively, the housing 140, 240 may be provided with holes 62 shown in FIG. 8 in place of the alignment pins 42 and the panel, on which the housing is mounted, may have alignment pins that fit into the holes in the housing for alignment purposes.

Figure 2:
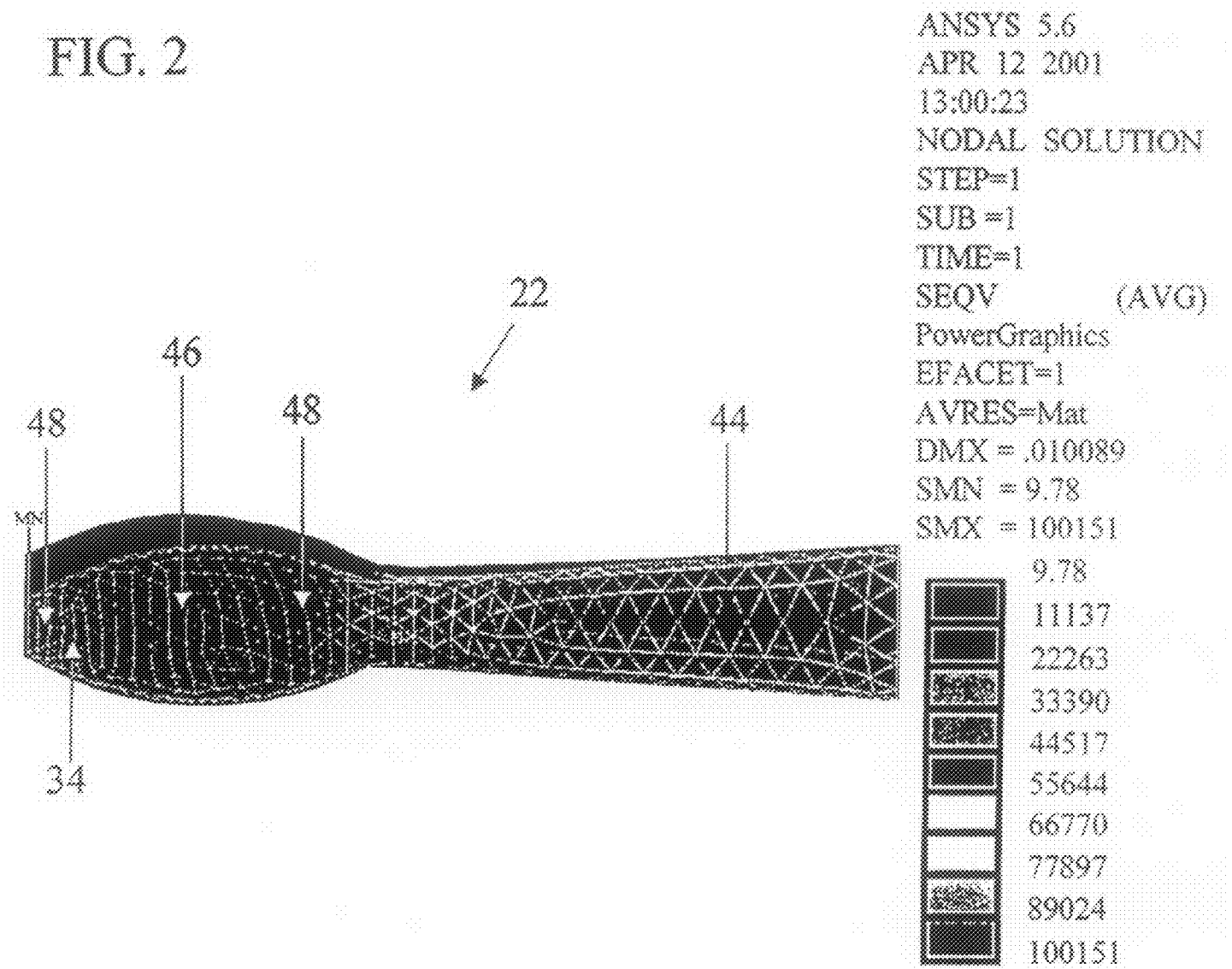
FIG. 2 is a side view of a proximal portion of a central contact.

FIG. 2 is a side view of a proximal portion of the central contact 22 shown in FIG. 1. As previously described, the proximal portion 28 of the contact 22 has a tapered section 44 and terminates in a ball contact 34. In a preferred embodiment, the ball contact 34 is elliptical in shape although it may have other shapes such as cylindrical, or oval, for example. The ball contact 34 has a central portion 46 and end portions 48 adjacent to the central portion 46. The end portions 48 include a first portion that connects the ball contact 34 to the tapered portion 44 and a second portion opposite the first portion that defines the proximal termination of the contact 22. The ball contact 34 is thickest at its central portion 46.

Figure 3:
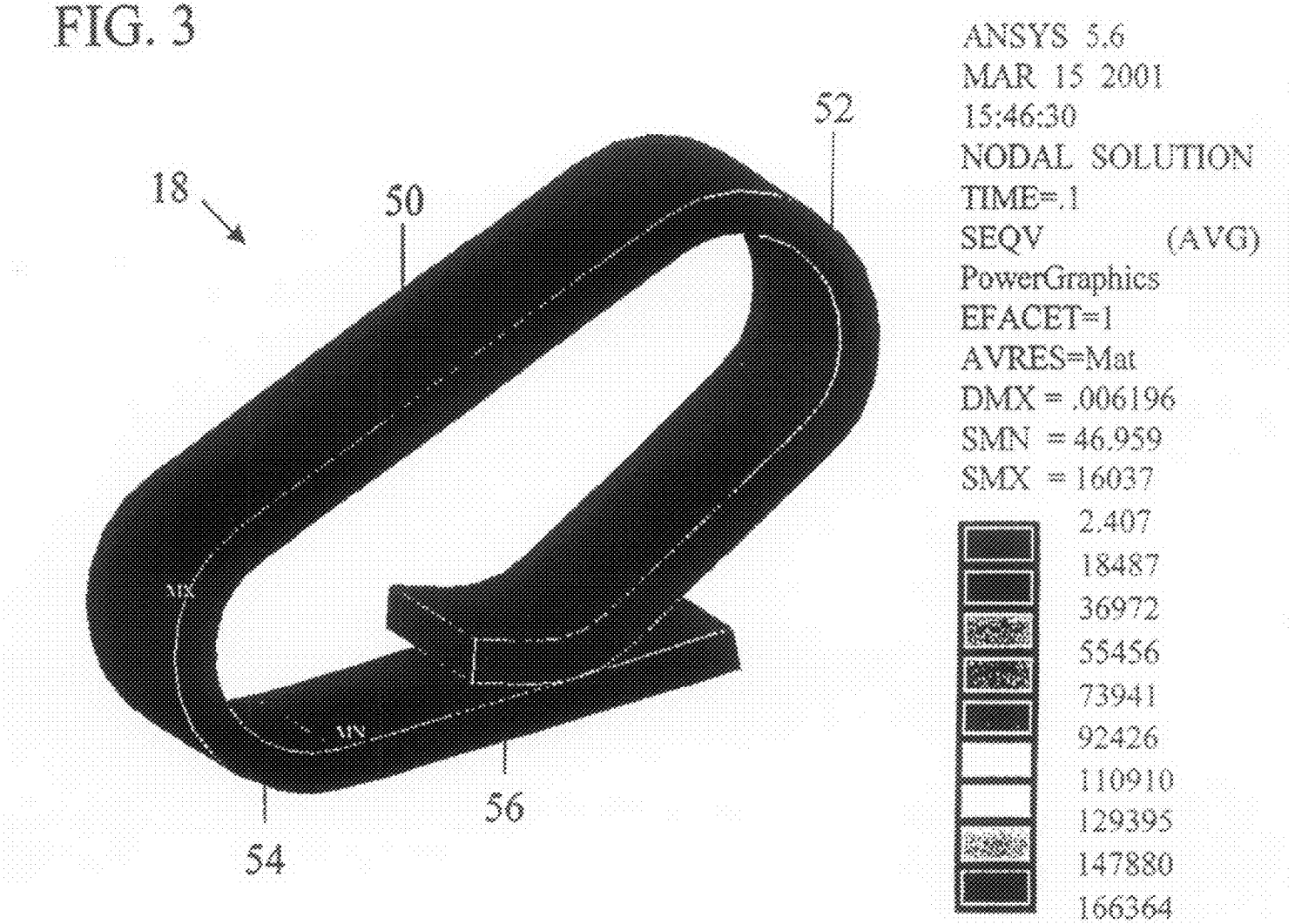
FIG. 3 is a perspective view of a ground clip according to a preferred embodiment the present invention.

FIG. 3 is a perspective view of a ground clip 18 according to a preferred embodiment the present invention. The ground clip is a spring having an elongated flat section 50, a first folded-over section 52 coupled at one end of the elongated flat section 50 and a second folded-over section 54 coupled at an opposite end of the elongated flat section 50. The first folded-over section 52 has a free end 56 that rides over a portion of the second folded-over section 54 to provide a spring force to the ground clip 18 so that when the adapter 10 is coupled to the printed circuit board 12, the ground clip 18 is compressed so that the elongated flat section 50 mates with a ground 60 shown in FIG. 1 located on an underside of the printed circuit board 12.

Figure 4:
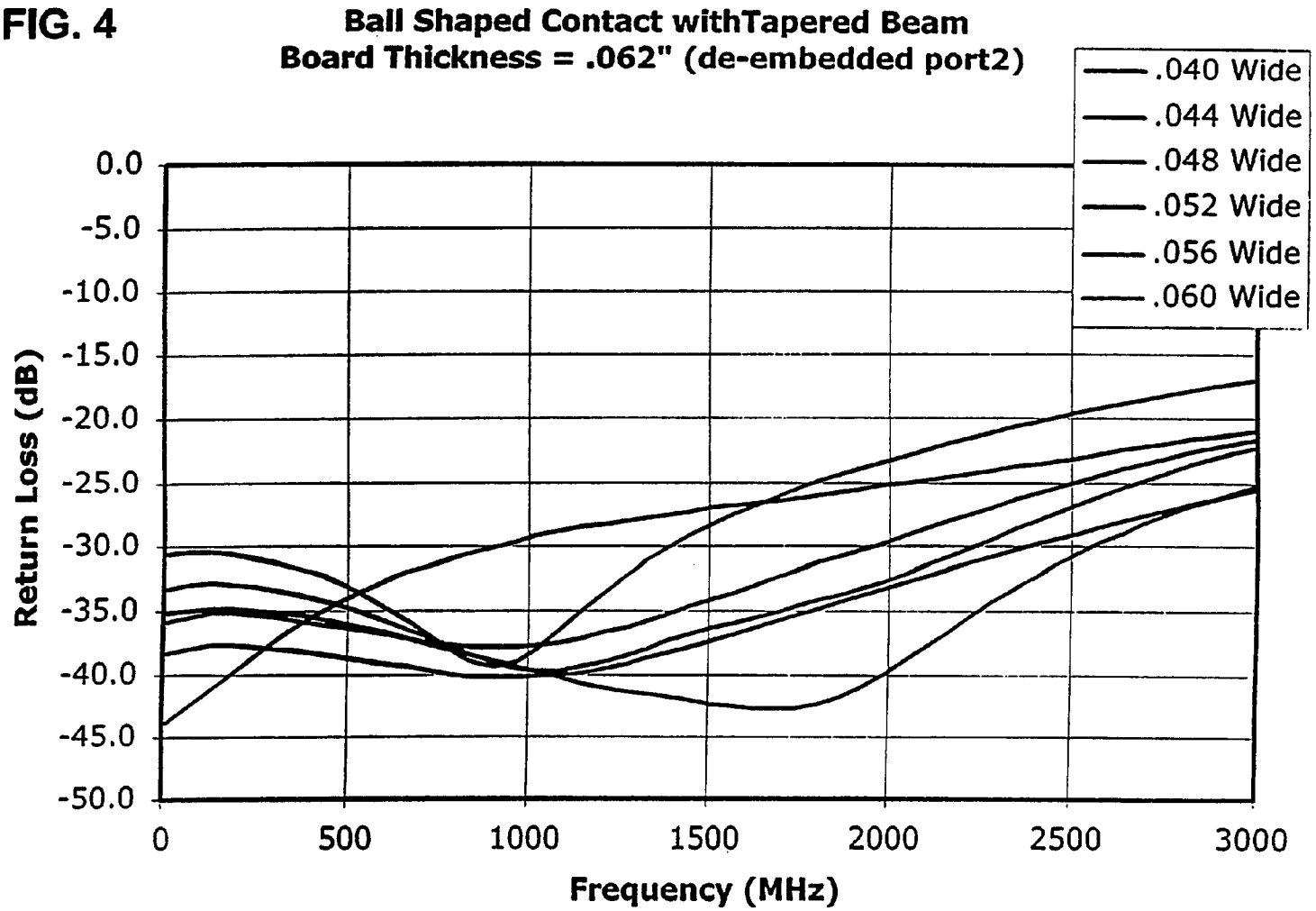
FIG. 4 is a graph illustrating simulated return loss for an adapter used with a printed circuit board having a first thickness according to a preferred embodiment of the present invention.

FIG. 4 is a graph illustrating simulated return loss for an adapter used with a printed circuit board having a first thickness according to a preferred embodiment of the present invention for various trace widths. A simulation was run for a contact as shown in FIG. 2 and a printed board thickness of about 0.062 inches. Return loss in decibels was plotted on the vertical axis and frequency in Megahertz was plotted along the horizontal axis. It can be seen from the graph that the simulated return loss is better than −30 decibels from dc to 2500 MHz.

Figure 5:
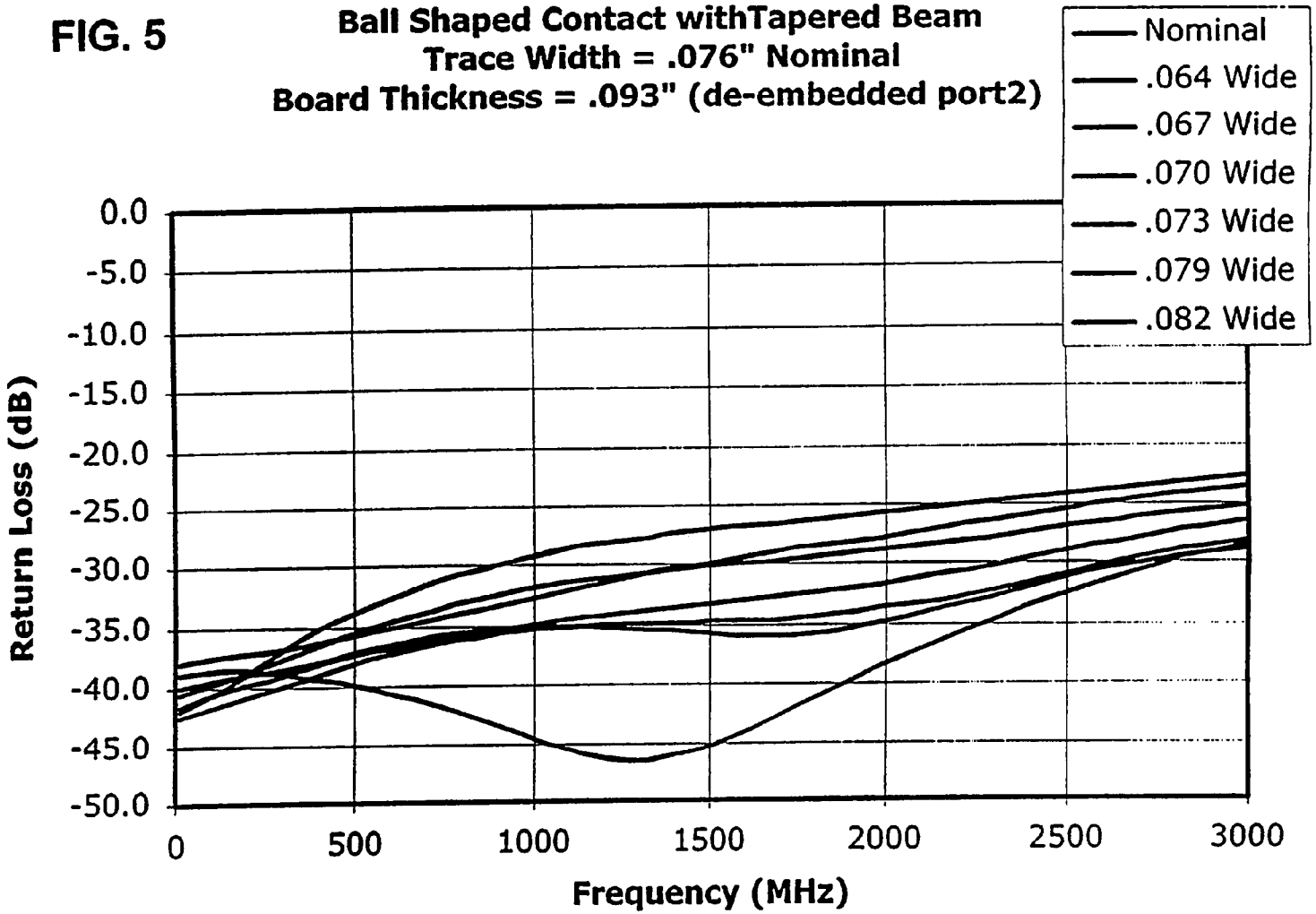
FIG. 5 is another graph illustrating simulated return loss for an adapter used with a printed circuit board of a second thickness according to a preferred embodiment of the present invention.

FIG. 5 is another graph illustrating simulated return loss for an adapter used with a printed circuit board of a second thickness according to a preferred embodiment of the present invention for various trace widths. A simulation was run for a contact as shown in FIG. 2 and a printed board thickness of about 0.093 inches. Return loss in decibels was plotted on the vertical axis and frequency in Megahertz was plotted along the horizontal axis. It can be seen form the graph that the simulated return loss is better than −30 decibels from dc to 2500 MHz.

The adapter has the advantage that it does not require permanent couplings such as solder or tools to assemble the adapter to a printed circuit board so that the adapter can be easily and quickly replaced. In addition, the adapter is modular so that it can be used singularly or in an array. The adapter design is also independent of the coaxial connector interface so that various styles of coaxial connectors may be used with the adapter.

The above specification, examples and data provide a complete description of the manufacture and use of the composition of the invention. Since many embodiments of the invention can be made without departing from the spirit and scope of the invention, the invention resides in the claims hereinafter appended.

We claim:

1. A solderless printed circuit board edge connector comprising:

a housing including a first end and a second end, wherein at least a portion of an inner surface of the housing is non-conductive, wherein the non-conductive portion includes a cylindrical recess;

a conductive cylindrical connector, the conductive cylindrical connector being positioned partially within the cylindrical recess of the housing and partially outside of the housing;

a conductive center connector positioned within the conductive cylindrical connector;

a first contact electrically connected to the conductive center connector positioned between the first and second ends of the housing;

a second contact electrically connected to the conductive cylindrical connector positioned between the first and second ends of the housing;

wherein the distance between the first and second contacts increases when the printed circuit board edge connector engages a printed circuit board.

2. The edge connector of claim 1, wherein the non-conductive inner surface of the housing is shaped to receive an end portion of the conductive cylindrical connector.

3. The edge connector of claim 1, wherein the conductive cylindrical connector is press fit into the housing.

4. The edge connector of claim 1, further comprising an insulator positioned within the conductive cylindrical connector, wherein the conductive center connector is positioned within the insulator.

5. The edge connector of claim 1, wherein the housing is entirely constructed of a non-conductive material.

6. The edge connector of claim 1, wherein the first contact deflects when the printed circuit board edge connector engages a printed circuit board.

7. The edge connector of claim 1, wherein the second contact deflects when the printed circuit board edge connector engages a printed circuit board.

8. The edge connector of claim 1, wherein both the first and second contacts deflect when the printed circuit board edge connector engages a printed circuit board.

9. The edge connector of claim 1, wherein the return loss is better than −30 decibel from 0 Megahertz to 2500 Megahertz for printed circuit boards having a thickness of between 0.062 inches to 0.093 inches.

10. A solderless printed circuit board edge connector comprising:

a housing including a first end and a second end, wherein at least a portion of an inner surface of the housing is non-conductive;

a conductive cylindrical connector, the conductive cylindrical connector being positioned partially within the housing and partially outside of the housing;

a conductive center connector positioned within the conductive cylindrical connector;

a first contact electrically connected to the conductive center connector positioned between the first and second ends of the housing;

a second contact electrically connected to the conductive cylindrical connector positioned between the first and second ends of the housing;

wherein the distance between the first and second contacts increases when the printed circuit board edge connector engages a printed circuit board;

wherein the return loss is better than −30 decibel from 0 Megahertz to 2500 Megahertz for printed circuit boards having a thickness of between 0.062 inches to 0.093 inches.

* * * * *